United States Patent [19]

Sashihara et al.

[11] 4,102,312

[45] Jul. 25, 1978

[54] THERMALLY DEVELOPABLE LIGHT-SENSITIVE MATERIALS

[75] Inventors: Kenji Sashihara; Takao Masuda, both of Asaka, Japan

[73] Assignee: Fuji Photo Film Co., Ltd., Minami-ashigara, Japan

[21] Appl. No.: 627,315

[22] Filed: Oct. 30, 1975

[30] Foreign Application Priority Data

Oct. 30, 1974 [JP] Japan ..... 49-125037

[51] Int. Cl.[2] ..... G03C 1/02; G03C 1/00; G03C 3/00; G03C 1/30

[52] U.S. Cl. ..... 96/114.1; 96/48 HD; 96/88; 96/67; 96/110

[58] Field of Search ..... 96/114.1, 110, 48 HD, 96/48 PD, 67, 88

[56] References Cited

U.S. PATENT DOCUMENTS

| | | | |
|---|---|---|---|
| 2,448,060 | 8/1948 | Smith et al. | 96/108 |
| 2,472,631 | 6/1949 | Stauffer et al. | 96/110 |
| 2,552,229 | 5/1951 | Stauffer et al. | 96/110 |
| 2,566,263 | 8/1951 | Trivelli et al. | 96/110 |
| 3,598,587 | 8/1971 | Yudelson et al. | 96/48 |
| 3,719,490 | 3/1973 | Yudelson et al. | 96/48 |
| 3,957,493 | 5/1976 | Masuda et al. | 96/114.1 |

*Primary Examiner*—Dennis E. Talbert, Jr.
*Assistant Examiner*—L. Falasco
*Attorney, Agent, or Firm*—Finnegan, Henderson, Farabow & Garrett

[57] ABSTRACT

A thermally developable light-sensitive material comprising a support having thereon or therein at least one layer containing at least (a) an organic silver salt, (b) a light-sensitive silver halide or a component capable of forming a light-sensitive silver halide, and (c) a reducing agent, which contains (d) a palladium-containing compound in at least one layer provided on or in the support.

12 Claims, 1 Drawing Figure

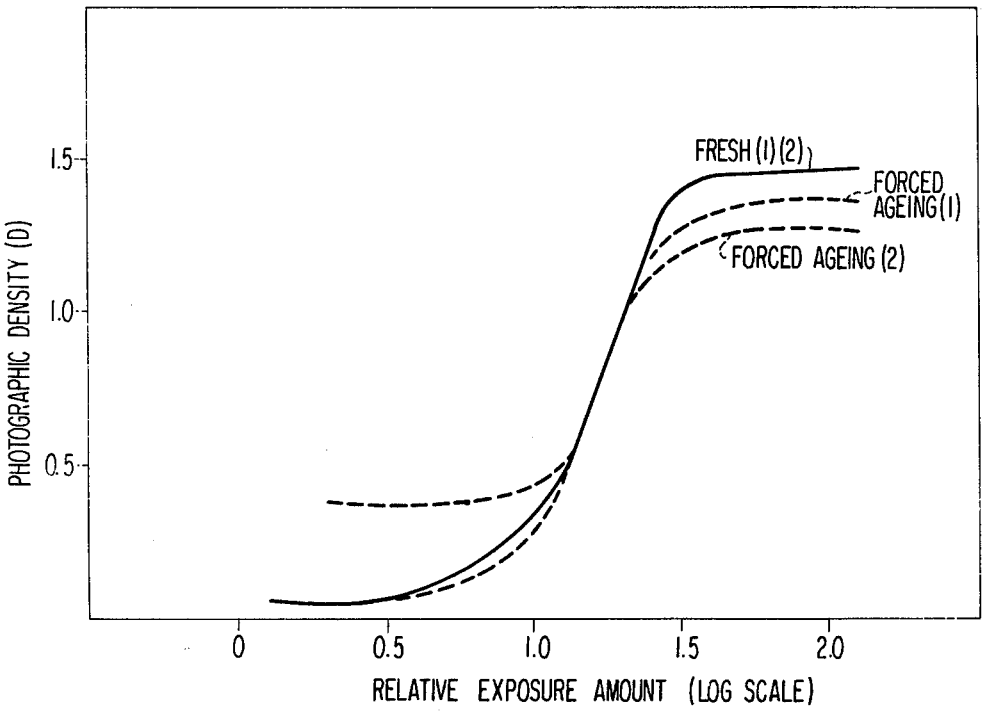
FRESH (1) (2)
FORCED AGEING (1)
FORCED AGEING (2)
PHOTOGRAPHIC DENSITY (D)
1.5
1.0
0.5
0
0.5
1.0
1.5
2.0
RELATIVE EXPOSURE AMOUNT (LOG SCALE)

THERMALLY DEVELOPABLE LIGHT-SENSITIVE MATERIALS

BACKGROUND OF THE INVENTION

1. Field of the Invention

This invention relates to a thermally developable light-sensitive material, and more particularly, to a thermally developable light-sensitive material which shows reduced thermal fog (undesirable fog caused in unexposed portions upon image-wise exposing and developing by heat) due to the presence of a palladium-containing compound.

2. Description of the Prior Art

Photographic processes using silver halide have been widely employed since such processes provide excellent photographic properties such as sensitivity and gradation as compared with electrophotography, diazo-type photographic process and other photographic processes. However, silver halide light-sensitive materials used for silver halide photographic processes must be developed with a developer after image-wise exposure, and then subjected to several bath processings for stopping, fixing, washing or stabilizing so as to prevent the developed image from becoming discolored or faded under normal light, and also to prevent undeveloped white portions (the background) from being blackened. Such processings require much time and are laborious, and, in addition, there are many problems such as the danger to humans handling the chemicals involved, contamination of processing rooms or contamination of the bodies or clothing of operators, and environmental pollution due to discharging the processing solutions into streams. Therefore, it has been desired to provide highly sensitive photographic materials containing silver halide which can be dry processed, i.e., without bath processings, which can provide stable images after processing and which also have a background that does not discolor under normal light conditions.

For this purpose, various efforts have been made. For example, it is described in German Pat. Nos. 1,123,203 and 1,174,157 that the incorporation of a 3-pyrazolidone developing agent into a silver halide emulsion enables development by heat, and in this case, the reaction is accelerated by the presence of a substance capable of supplying water on heating, as described in German Pat. No. 1,175,075. Furthermore, German Pat. No. 1,003,578 discloses that a silver halide fixing agent can also be present. However, these techniques cannot render silver halides completely stable to light which remain in a light-sensitive material after dry processing.

The three patents first mentioned above do not describe fixing in a dry processing, and with the invention disclosed in the latter patent, undesirable reaction occurs upon storage since the developing agent (reducing agent) and the fixing agent are present together, and therefore, its practical use is low.

At present, the most successful light-sensitive materials capable of forming a photographic image by dry processing are thermally developable light-sensitive materials which employ a composition containing, as essential components, a silver salt of an organic acid, a small amount of silver halide and a reducing agent, as described in U.S. Pat. Nos. 3,152,904 and 3,457,075. Although in such light-sensitive systems silver halide remains in the light-sensitive material after development and is not stabilized to light, they exhibit the same effect as in the case of stabilizing the silver halide, as silver halide is used in a small amount and the majority of the system is a white or light-colored stable organic silver salts which is not blackened by light. Therefore, even if a small amount of silver halide is discolored by light, the light-sensitive material appears white or light-colored as a whole, and such slight discoloration is not visually bothersome.

Such light-sensitive materials are stable at ambient temperatures, but when they are heated to 80° C or more, preferably to 100° C or more, after being image-wise exposed, the oxidizing agent for the organic silver salt and the reducing agent in the light-sensitive layer undergo a redox reaction due to the catalytic effect of the exposed silver halide near the agents to yield silver, by which exposed portions in the light-sensitive layer are rapidly blackened to contrast with unexposed portions (the background), thus forming an image.

However, in the thermally developable light-sensitive materials which have so far been proposed, e.g., in a combination comprising a silver salt of an aliphatic acid such as silver behenate, a reducing agent and a catalytic amount of silver halide, heating results in considerable blackening in unexposed portions (which is referred to as thermal fox hereinafter), which provides no contrast with the blackening (image density) in exposed portions produced by heating, so that the formed image becomes illegible. Therefore, it is an important subject to reduce thermal fog.

Moreover, when such light-sensitive materials are stored for a long period of time prior to use, particularly at high temperature (from 30° to 50° C) and high humidity (relative humidity of 50% or more), thermal fog is also produced, and only illegible images can be obtained.

It is known that mercury compounds improve the aforementioned defects, as described in Japanese Pat. No. 11,113/72. However, mercury compounds are poisonous and, therefore, can cause serious environmental pollution problems, e.g., upon development by heat, mercury is evaporated off, or on using such a light-sensitive paper as regenerated paper, mercury escapes into streams.

SUMMARY OF THE INVENTION

As a result of studies to overcome the above-described problems of the prior art, the inventors achieved this invention.

It is an object of this invention to provide a thermally developable light-sensitive material which shows less thermal fog, particularly, a thermally developable light-sensitive material in which thermal fog does not occur even when it is stored for long periods of time at high temperatures.

Another object of this invention is to provide a thermally developable light-sensitive material of low toxicity.

This invention provides a thermally developable light-sensitive material comprising a support having thereon or therein at least one layer containing at least (a) an organic silver salt, (b) a light-sensitive silver halide or a component capable of forming a light-sensitive silver halide and (c) a reducing agent, in which (d) a palladium-containing compound is further present in at least one layer provided on or in the support.

Other objects of this invention will be apparent from the description and examples which follow.

BRIEF DESCRIPTION OF THE DRAWING

The FIGURE shows the characteristic curves of a thermally developable light-sensitive material of this invention and a conventional one.

DETAILED DESCRIPTION OF THE INVENTION

Suitable palladium-containing compounds which are the characteristic feature [component (d)] of this invention are complex salts of palladium with a ligand containing a ligand atom such as N, O, S, P, As and halogen (F, Cl, Br, I). Those complex salts are preferred in which the electric charge of the ligand offsets the internal charge of the palladium to provide a neutral molecule. Particularly preferred complex salts are those soluble in organic solvents such as acetone, for example, palladium complex salt of acetylacetone (referred to merely as acac hereinafter).

A suitable amount of the palladium-containing compound used ranges from about $10^{-8}$ to about $10^{-2}$ mol, preferably about $10^{-6}$ to $10^{-1}$ mol, per mol of the organic silver salt [component (a)].

Apart from the mechanism through which the palladium-containing compound of this invention enables the achievement of the above objects, it was very surprising to the inventors, who have been active in this field for many years, that by incorporation of the palladium-containing compound of this invention, the occurrence of thermal fog in the thermally developable light-sensitive materials, particularly upon storage at high temperatures, can be prevent.

Specific examples of palladium-containing compounds include those of the formula:

$$Pd(R_1COCHCOR_2)_2$$

wherein $R_1$ and $R_2$ have the following meaning:

| Compound | $R_1$ | $R_2$ |
|---|---|---|
| 1 | $C_6H_5$ | $C_6H_5$ |
| 2 | $C_6H_5$ | $CH_3$ |
| 3 | $CH_3$ | $CH_3$ |
| 4 | $CF_3$ | $CH_3$ |

those of the formula:

$$L_2PdX_2$$

wherein L and X have the following meaning:

| Compound | L | X |
|---|---|---|
| 5 | $C_6H_5CH_2SCH_2C_6H_5$ | Cl |
| 6 | 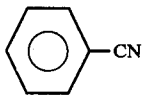 | Cl |
| 7 | $CH_2{=}CHCN$ | Cl |
| 8 | 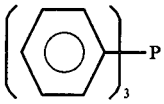 | Cl |
| 9 | $(C_2H_5)_3{-}P$ | Br |

-continued

| Compound | L | X |
|---|---|---|
| 10 | 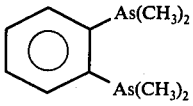 | I |
| 11 | 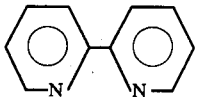 | Cl |

and $Pd(DMGH)_2$, wherein DMGH means

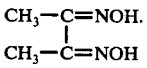

In the above described compounds, Pd forms complex salts with a lignad wherein the ligand atom is S, N, P, As, or a halogen.

Most especially, the acetylacetone (acac) complex salt of palladium (compound 3) is preferred.

These compounds can be synthesized by the processes disclosed in *Inorg. Syn.* 11, 108 (1968), *J.Chem. Soc.*, 1549 (1935) *J. Chem. Soc.*, 662 (1947) and C. A. 47, 11060g (1953).

The organic silver salts employed as component (a) in the invention are colorless, white or slightly colored silver salts which are comparatively stable to light and which react with the reducing agents to form silver images when heated to a temperature of about 80° C or higher, preferably 100° C or higher, in the presence of an exposed silver halide. Examples of organic silver salts include silver salts of organic compounds containing an imino group, a mercapto group, a thione group or a carboxyl group. Typical examples of these organic silver salts include:

(1) Silver salts of organic compounds containing an imino group:

Silver benzotriazole, silver nitrobenzotriazole, silver alkyl-substituted benzotriazoles (e.g., silver methylbenzotriazole), silver halogen-substituted benzotriazoles (e.g., silver bromobenzotriazole or silver chlorobenzotriazole), silver carboimide-substituted benzotriazoles (e.g.,

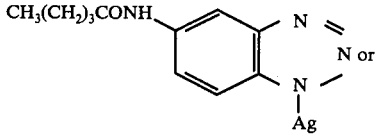

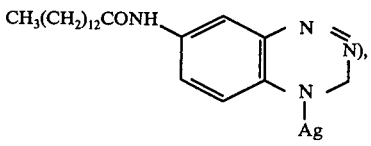

silver benzimidazole, silver substituted-benzimidazoles (e.g., silver 5-chlorobenzimidazole or silver 5-nitrobenzimidazole), silver carbazole, silver saccharin, silver phthalazinone, silver substituted-phthalazinone, silver salts of phthalimides, silver pyrrolidone, silver tetrazole and silver imidazole;

(2) Silver salts of organic compounds containing a mercapto group or a thione group:

Silver 3-mercapto-4-phenyl-1,2,4-triazole, silver 2-mercaptobenzimidazole, silver 2-mercapto-5-aminothiadiazole, silver 1-phenyl-5-mercaptotetrazole, silver 2-mercaptobenzothiazole, silver salts of the thioglycolic acids as described in Japan Patent Application (OPI) 28,221/73 (e.g., silver 2-(S-ethylenethioglycolamido)-benzothiazole or silver S-alkyl-($C_{12}$-$C_{22}$)thioglycolates), silver salts of dithiocarboxylic acids (e.g., silver dithioacetate), silver thioamide, silver salts of thiopyridines (e.g., silver 5-carbethoxy-1-methyl-2-phenyl-4-thiopyridine), silver dithiodihydroxybenzole, silver mercaptotriazine, silver 2-mercaptobenzoxazole and silver mercaptooxadiazole, etc.;

(3) Silver salts of organic compounds containing a carboxylic group:

(a) Silver salts of aliphatic carboxylic acids:

Silver caprate, silver laurate, silver myristate, silver palmitate, silver stearate, silver behenate, silver maleate, silver fumarate, silver tartarate, silver furoate, silver linolate, silver oleate, silver hydroxystearate, silver adipate, silver sebacate, silver succinate, silver acetate, silver butyrate and silver camphorate;

(b) Silver aromatic carboxylates and the others:

Silver benzoate, silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver salts of other substituted benzoic acids, silver gallate, silver tannate, silver phthalate, silver terephthalate, silver salicylate, silver phenylacetate, silver pyromellitate, silver 4'-n-octadecyloxydiphenyl-4-carboxylate, silver thionecarboxylates as disclosed in U.S. Pat. No. 3,785,830 and silver salts of aliphatic carboxylic acids containing a thioether group as disclosed in U.S. Pat. No. 3,330,663;

(4) Other silver salts:

Silver 4-hydroxy-6-methyl-1,3,3a,7-tetraazaindene, silver 5-methyl-7-hydroxy-1,2,3,4,6-pentaazindene, silver tetraazindene as disclosed in British Pat. No. 1,230,642, silver S-2-aminophenylthiosulfate as disclosed in U.S. Pat. No. 3,549,379, metal-containing aminoalcohols as disclosed in British Pat. No. 1,346,595, and organic acid-metal chelates as disclosed in U.S. Pat. No. 3,794,496.

An oxidizing agent such as titanium dioxide, zinc oxide or gold carboxylates (e.g., aurous laurate, aurous stearate or aurous behenate) other than silver salts can be employed together with the organic silver salt, if desired.

Various processes are known for preparing such organic silver salts. One of the simplest processes for preparing them is described in U.S. Pat. No. 3,457,075 wherein a solution of an organic silver salt forming agent or a salt thereof in a water-miscible solvent, such as an alcohol or acetone, or water is mixed with an aqueous solution of a water-soluble silver salt such as silver nitrate to prepare an organic silver salt.

Further, it is possible to use the process described in U.S. Pat. No. 3,839,049 wherein a colloidal dispersion of an ammonium salt or an alkali metal salt of an organic silver salt forming agent is mixed with an aqueous solution of a water-soluble silver salt such as silver nitrate. In a similar process, it is possible to use an aqueous solution of a silver complex salt such as a silver amine complex salt or a solution of such a salt in a water-miscible solvent instead of the aqueous solution of the water-soluble silver salt such as silver nitrate.

Another process for preparing organic silver salts is the process described in U.S. Pat. No. 3,458,544. Namely, in this process organic carboxylic acid silver salts are prepared by mixing a water difficultly-miscible solution (oily solution) such as a benzene solution of an organic carboxylic acid with an aqueous solution of a silver complex salt. Preferably the water is added to the oily solution to form an emulsion prior to mixing with the aqueous solution of the silver complex salt. This process can be also applied to the preparation of other organic silver salts.

A similar process has been described in Canadian Pat. No. 847,351 wherein the resulting organic silver salts are more stable to heat and light. In this process, a silver salt solution without an alkali, such as an aqueous solution containing only silver nitrate, is used instead of the silver complex salt.

Further, a process for preparing organic silver salts is described in West German Patent Application (OLS) No. 2,402,906. This process is preferred because heat-developable light-sensitive materials containing the resulting organic silver salt do not form as much heat-fog (undesirable fog generated on the unexposed area when the light-sensitive material is heated). Namely, this process comprises mixing an emulsion composed of an aqueous solution of a salt (for example, an alkali metal salt such as a sodium salt, a potassium salt or a lithium salt or an ammonium salt, etc.) of a water-soluble organic silver salt forming agent and an oil (for example, benzene, toluene, cyclohexane, pentane, hexane, carboxylic acid esters such as an acetate, phosphoric acid esters, and oils such as castor oil, etc.) with a solution of, and preferably an aqueous solution of, a silver salt which is more water-soluble than the organic silver salt (such as silver nitrate) or a silver complex salt to prepare the organic silver salt. In another embodiment of this process, it is possible to prepare the organic silver salt by mixing an aqueous alkali solution (for example, an aqueous solution of sodium hydroxide) with an oil-soluble solution of an organic silver salt forming agent (for example, a toluene solution of the organic silver salt forming agent) and mixing the resulting emulsion with a solution, and preferably an aqueous solution, of a soluble silver salt such as silver nitrate or a silver complex salt such as a silver ammine complex salt.

The oils which can be used for the above-described oily solution include the following compounds:

(1) Phosphoric acid esters: For example, tricresyl phosphate, tributyl phosphate, and monooctyl dibutyl phosphate, etc.

(2) Phthalic acid esters: For example, diethyl phthalate, dibutyl phthalate, dimethyl phthalate, dioctyl phthalate and dimethoxyethyl phthalate, etc.;

(3) Carboxylic acid esters: For example, acetates such as amyl acetate, isopropyl acetate, isoamyl acetate, ethyl acetate, 2-ethylbutyl acetate, butyl acetate and propyl acetate, etc.; sebacates such as dioctyl sebacate, dibutyl sebacate, and diethyl sebacate, etc.; succinates such as diethyl succinate; formates such as ethyl formate, propyl formate, butyl formate and amyl formate, etc.; tartarates such as diethyl tartarate; valerates such as ethyl valerate; butyrates such as methyl butyrate, ethyl butyrate, butyl butyrate and isoamyl butyrate; and adipic acid esters, etc.;

(4) Oils such as castor oil, cotton seed oil, linseed oil and tsubaki oil, etc.;

(5) Aromatic hydrocarbons such as benzene, toluene and xylene, etc.;

(6) Aliphatic hydrocarbons such as pentane, hexane and heptane, etc.; and (7) Cyclic hydrocarbons such as cyclohexane.

Examples of silver complex salts include silver ammine complex salt, silver methylamine complex salt and silver ethylamine complex salt; preferably alkali-soluble complex salts having a dissociation constant higher than the organic silver salts are suitably used.

Examples of solvents for the silver salts such as silver nitrate include not only water but also polar solvents such as dimethyl sulfoxide, dimethylformamide and acetonitrile, etc.

Further, ultrasonic waves can be employed during the preparation of the organic silver salts as described in West German Patent Application (OLS) No. 2,401,159. Particularly, emulsification can be easily carried out by applying ultrasonic waves when it is desired to emulsify water and oils. Further, it is possible to use surface active agents for the purpose of controlling the particle size of the organic silver salts during the preparation thereof.

The organic silver salts can also be prepared in the presence of polymers. A specific process has been described in U.S. Pat. No. 3,700,458, which comprises mixing a non-aqueous solution of an organic carboxylic acid with a non-aqueous solution of a heavy metal salt of trifluoroacetate or tetrafluoroborate in the presence of a polymer to produce a heavy metal salt of the organic carboxylic acid such as a silver salt thereof. A process which comprises reacting a colloid dispersion of an organic silver salt forming agent with an aqueous solution of silver nitrate has been described in U.S. Pat. No. 3,839,049.

U.S. Pat. No. 3,748,143 also described a method of preparing an emulsion using similar non-aqueous solutions. Further, in preparing the organic silver salts, a metal salt or a metal complex such as a mercury compound or a lead compound can be added to the reaction system in order to vary the shape of the grains of the organic silver salt or the grain size, and to vary photographic characteristics such as thermal fog, light stability and sensitivity. In addition to mercury and lead, metals such as cobalt, manganese, nickel and iron are also effective. The palladium-containing compound of this invention can also be used in preparing the organic silver salts.

Furthermore, a process for producing an emulsion using similar non-aqueous solutions has been described in U.S. Pat. No. 3,748,143. In addition, it is possible, as described in Japanese Patent Application (OPI) No. 13,224/1974 and West German Patent Application (OLS) No. 2,322,096, to change the particle form, the particle size and photographic properties such as light stability or sensitivity of the organic silver salts due to the presence of a metal salt or a metal complex such as a mercury or lead compound during the preparation of the organic silver salts.

It has been also confirmed that cobalt, manganese, nickel, iron, rhodium, iridium, platinum, gold, cadmium, zinc, lithium, copper, thallium, tin, bismuth, antimony, chromium, ruthenium, and osmium in addition to the mercury and lead described above are effective as the metal. In order to use these metal containing compounds, a mixture or dispersion of a solution of a silver salt forming organic compound and a metal containing compound can be mixed with an aqueous solution of a soluble silver salt such as silver nitrate or an aqueous solution of a silver complex salt such as a silver ammine complex salt. Further, a solution or dispersion of the metal containing compound can be mixed with an aqueous solution of the silver salt or a silver complex salt and a solution or dispersion of the silver salt forming organic compound. Furthermore, a method comprising mixing a solution or dispersion of the silver salt forming organic compound with a solution or dispersion of a mixture of the silver salt or silver complex salt and the metal containing compound is also preferred. A preferred amount of the metal containing compound ranges from about $10^{-6}$ to $10^{-1}$ mols per mol of the organic silver salt and from about $10^{-5}$ to $10^{-2}$ mols per mol of the silver halide.

The particle size of thus-resulting organic silver salts is about 0.01 micron to about 10 microns as the longer diameter, preferably about 0.1 micron to about 5 microns.

The palladium-containing compound as component (d) of this invention can be added during or prior to forming the organic silver salt, e.g., in a stage prior to the formation of silver halide. Moreover, the palladium-containing compound may be added during the formation of the silver halide as described below, or added after the formation of the silver halide.

Om comparing the above times, it is most preferred to add the palladium-containing compound after the formation of the silver halide.

In particular, when the palladium-containing compound as component (d) of this invention is added after the formation of silver halide and then allowed to stand at room temperature or higher temperatures (20° to 80° C) for an adequate time (e.g., 10 minutes to 48 hours), the amount of the palladium-containing compound used as component (d) can be reduced as compared with the case of a system not subjected to such processing. For example, in producing the heat developable light-sensitive material of this invention the following procedure is often used:

(i) Forming component (a)—(organic silver salt), e.g., $AgNO_3$ + sodium salt of long chain carboxylic acid reacted to silver salt of long chain carboxylic acid.

(ii) AgX brought into intimate contact with portion of component (a), e.g., silver salt of long chain carboxylic acid + KBr reacted to K salt of long chain carboxylic acid + AgBr.

(iii) Dyes, heat fogging inhibitors, color toning agents, reducing agents etc. added.

(iv) Pd- compound added at any stage of the above scheme.

Examples of light-sensitive silver halides which can be employed as component (b) in the invention include silver chloride, silver bromide, silver iodide, silver chlorobromoiodide, silver chlorobromide, silver chloroiodide, silver iodobromide and a mixture thereof. The light-sensitive silver halide can be coarse particles or fine particles, but preferably is fine particles. A preferred particle size of the silver halide is about 0.001 to 1 micron, more preferably about 0.01 to 0.5 micron, in the longer diameter.

The light-sensitive silver halide can be prepared by any of the procedures known in the field of photography, such as a single jet procedure and a double jet procedure. Examples of silver halides used in this invention include these prepared by a Lippmann process, an ammoniacal process and a thiocyanate or thioether ripening process. The silver halide used can be unwashed or washed, e.g., with water, alcohols, etc. to remove soluble salts.

The silver halide used in the invention can be chemically sensitized with a chemical sensitizer such as sulfur, selenium, tellurium, gold, platinum, a stannous halide, etc., e.g., as disclosed in U.S. Pat. Nos. 1,623,499, 2,399,083 and 3,297,447. The silver halide preferably contains an antifoggant or a stabilizer such as a thiazolium salt, an azaindene, a mercury salt, a urazole, a sulfocatechol, an oxime, a nitron, a nitroindazole, etc., to stabilize the silver halide to fog, e.g., as disclosed in U.S. Pat. Nos. 2,728,663, 2,839,405, 2,566,263, 2,597,915 and British Pat. No. 623,448.

The silver halide emulsion prepared in advance can be mixed with an oxidation-reduction composition comprising an organic silver salt and a reducing agent, as described in U.S. Pat. No. 3,152,904. According to this method, however, sufficient contact is not attained between the silver halide and the organic silver salt (e.g., as disclosed in U.S. Pat. No. 3,457,075). In order to achieve good contact between the silver halide and the organic silver salt, various techniques can be employed. One effective technique is to mix the materials in the presence of a surface active agent, as described in British Pat. No. 1,469,116 and U.S Pat. No. 4,076,539. According to another method a silver halide is prepared in the presence of a polymer and then mixed with an organic silver salt (for example, as disclosed in U.S. Pat. Nos. 3,705,565; 3,713,833; 3,706,564 and 3,761,273; British Pat. Nos. 1,354,186 and 2,078,586; and Belgian Pat. No. 774,436.

The light-sensitive silver halide employed in the invention can be simultaneously prepared with the preparation of the organic silver salt as disclosed in British Pat. No. 1,447,454. That is, the silver halide can be prepared by mixing a silver salt (e.g., silver nitrate or a silver complex salt) solution with a solution or dispersion of an organic silver salt-forming compound or a salt thereof and a silver halide forming compound solution, or by mixing a silver halide-forming compound solution and a solution or dispersion of an organic silver salt-forming compound or a salt thereof and a solution of a silver salt such as silver nitrate or a silver complex salt, whereby silver halide is prepared simultaneously with the organic silver salt. Further, the light-sensitive silver halide employed in the invention can be prepared by a partial conversion of the organic silver salt by subjecting a solution or dispersion of the previously prepared organic silver salt to a silver halide forming compound or a sheet material containing an organic silver salt with a silver halide forming compound. The thus-prepared silver halide is effectively contacted with the organic silver salt to provide preferred results as disclosed in U.S. Pat. No. 3,457,075.

The light-sensitive silver halide forming components which can be employed in this invention include any compounds capable of forming silver halide on reaction with the organic silver salt. Whether the compounds can be employed as a silver halide forming component can be determined by a routine test. For example, after mixing a compound for forming a silver halide with the organic silver salt, and, if necessary, heating, the X-ray diffraction pattern obtained by an X-ray diffraction method is examined to determine whether diffraction peaks inherent to silver halide are present. If so, the compound is useful.

Examples of silver halide forming components include the following compounds.

(1) Inorganic halides: For example, halides represented by the formula $MX'_n$, wherein M represents H, $NH_4$ or a metal atom, X' represents Cl, Br or I, and $n$ is 1 if M represents H or $NH_4$, or $n$ represents the valence of the metal atom if M represents a metal atom. Examples of suitable metal atoms include lithium, sodium, potassium, rubidium, cesium, copper, gold, beryllium, magnesium, calcium, strontium, barium, zinc, cadmium, mercury, aluminium, gallium, indium, thallium, germanium, tin, lead, antimony, bismuth, chromium, molybdenum, tungsten, manganese, rhenium, iron, cobalt, nickel, ruthenium, rhodium, palladium, osmium, iridium and platinum.

(2) Halogen containing metal complexes: For example, $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$ and $(NH_4)_3RhBr_6$, etc.

(3) Onium halides: For example, quaternary ammonium halides such as trimethylphenyl ammonium bromide, cetylethyldimethyl ammonium bromide and trimethylbenzyl ammonium bromide, quaternary phosphonium halides such as tetraethyl phosphonium bromide and tertiary sulfonium halides such as trimethyl sulfonium iodide. Further, these onium halides can be used in final coating dispersions for the purpose of decreasing sensitivity or, if desired, decreasing the background density, as described in U.S. Pat. No. 3,679,422.

(4) Halogenated hydrocarbons: For example, iodoform, bromoform, carbon tetrabromide and 2-bromo-2-methylpropane, etc.

(5) N-halogen compounds: For example, compounds represented by the following formulae:

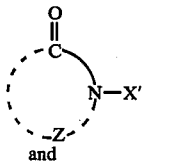

(II)

and

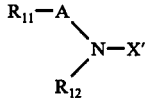

(III)

wherein X' represents Cl, Br or I; Z represents a group of atoms necessary to form a 5- or 6-membered ring, wherein the 5- or 6-membered ring may be condensed with another ring; A represents a carbonyl group or a sulfonyl group; and $R_{11}$ and $R_{12}$ each represents an alkyl group, an aryl group or an alkoxy group. For example, N-bromosuccinimide, N-bromophthalimide, N-bromoacetamide, N-iodosuccinimide and N-bromophthaladinone, etc., are suitable. These compounds have been described in detail in West German Patent Application (OLS) No. 2,453,131. In addition, N-halo compounds of benzotriazole and substituted benzotriazoles such as the alkyl, nitro, halo, imido or amino substituted benzotriazoles are also effective. Furthermore, N-bromobenzimidazoles are suitable.

(6) Other halogen containing compounds: For example, triphenylmethyl chloride, triphenylmethyl bromide, 2-bromobutyric acid, 2-bromoethanol and dichlorobenzophenone, etc.

Moreover, a conductive high molecular weight compound of the onium halide series can be used to make a thermally developable light-sensitive material or an electrosensitive material, as described in Japanese Patent Application (Laid-Open) No. 84,443/74.

In the above-described processes and the process of the present invention, the improvement of photographic properties, such as increase of sensitivity and elimination of heat-fog, etc., can be achieved by ripening by allowing the composition to stand at room temperature (about 20°–25° C) to a higher temperature (30°–80° C) for a suitable time (for example, 20 minutes to 48 hours) after addition of the silver halide forming component, if desired, in the presence of thiosulfate salts, other sulfur-containing compounds, metals such as gold, chromium, tin or lithium, reducing agents or combinations of such compounds.

The silver halide forming compound (or silver halide per se) can be employed individually or as a combination thereof. A suitable amount of the silver halide forming component (or silver halide per se) is about 0.001 to 0.5 mol, preferably about 0.01 to 0.3 mol, per mol of the organic silver salt employed as component (a). If the amount is more than about 0.5 mol, the color changes, which is an undesirable coloration of the background which occurs on allowing the exposed and developed light-sensitive material to stand under normal room illumination. If the amount is less than about 0.001, the sensitivity is reduced.

A silver halide prepared by any method can be chemically sensitized using, e.g., a chemical sensitizer such as a sulfur, selenium, or tellurium compound, gold or platinum compound, a reducing agent such as a tin halide, or a combination of such compounds. These compounds are described, e.g., in U.S. Pat. Nos. 1,623,499, 2,399,083 and 3,297,447. To prevent the formation of fog, an anti-fogging agent or a stabilizing agent such as thiazolium salt, azaindene, urazol, sulfocatechol, oxime, nitron or nitroindazole is preferably added to the light-sensitive silver halide emulsion used in this invention. These agents are described, e.g., in U.S. Pat. Nos. 2,728,663, 2,839,405, 2,566,263 and 2,597,915, and British Pat. No. 623,448. While the cited patents refer to chemically sensitizing agents employed in conventional silver halide emulsions which are diferent systems from the thermally developable light-sensitive material of this invention, surprisingly the compounds and techniques taught can be used for the heat-developable materials.

Certain spectral sensitizing dyes which are known to be effective for gelatin-silver halide emulsions can be used for the heat developable light-sensitive materials of the present invention in order to further increase the sensitivity. Effective spectral sensitizing dyes include cyanine, merocyanine, complex (trinuclear or tetranuclear) cyanine, halopolar cyanine, styryl, hemicyanine, oxonol and hemioxonol dyes. Of the cyanine dyes, those containing a basic nucleus such as a thiazoline, oxazoline, pyrroline, pyridine, oxazole, thiazole, selenazole, or imidazole ring are suitable. Further, such a nucleus can have an alkyl group, an alkylene group, a hydroxyalkyl group, a sulfoalkyl group, a carboxyalkyl group, an aminoalkyl group or an enamine group as a substituent or can form a condensed carbocyclic group or heterocyclic group. The cyanine dyes can be either symmetric or asymmetric. Further, the dyes can have an alkyl group, a phenyl group, an enamine group or a heterocyclic substituent on the methine chain or the polymethine chain thereof. Particularly, cyanine dyes containing a carboxyl group are effective for sensitization. The merocyanine dyes can contain an acid nucleus such as a thiohydantoin nucleus, a rhodanine nucleus, an oxazolidindione nucleus, a thiazolidindione nucleus, a barbituric acid nucleus, a pyrazolone nucleus or a malonitrile nucleus in addition to the above-described basic nucleus. These acid nuclei can be substituted with an alkyl group, an alkylene group, a phenyl group, a carboxyalkyl group, a sulfoalkyl group, a hydroxyalkyl group, an alkoxyalkyl group, an alkylamino group or a heterocyclic nucleus. Particularly, merocyanine dyes having an imino group or a carboxyl group are effective for sensitization. If desired, these dyes can be used as a combination of two or more thereof, Further, they can be used together with ascorbic acid derivatives, azaindenes, cadmium salts, organic sulfonic acids or supersensitizing additives which do not absorb visible light as described in, for example, U.S. Pat. Nos. 2,933,390 and 2,937,089, etc. Effective sensitizing dyes for the heat developable light-sensitive materials of the present invention include merocyanine dyes containing a rhodanine nucleus, a thiohydantoin nucleus or a 2-thio-2,4-oxazolidindione nucleus as described in U.S. Pat. No. 3,761,279, for example, 3-p-carboxyphenyl-5-[β-ethyl-2-(3-benzoxazolylidenyl)ethylidenyl]rhodanine, 5-[3-β-carboxyethyl-2-(3-thiazolinylidenyl)ethylidenyl]-3-ethyl rhodanine, 3-carboxymethyl-5-[3-methylthiazolinylidenyl)-α-ethylethylidenyl]rhodanine, 1-carboxymethyl-5-[3-ethyl-2-(3H)-benzoxazolylidenyl)ethylidenyl]-3-phenyl-2-thiohydantoin, 5-[(ethyl-2-benzoxazolylidenyl)-1-methylethylidenyl]-3-[(3-pyrrolin-1-yl)propyl]rhodanine and 3-ethyl-5-[(3-ethyl-2-(3H)-benzothiazolylidenyl)isopropylidenyl]-2-thio-2,4-oxazolidindione, etc. Trinuclear merocyanine dyes as described in U.S. Pat. No. 3,719,495, polynuclear aromatic dyes as described in Belgian Pat. No. 788,695, sensitizing dyes for silver iodide as described in West German Patent Application (OLS) No. 2,328,868, styrylquinoline dyes as described in West German Patent Application (OLS) No. 2,363,586, rhodacyanine dyes as described in West German Patent Application (OLS) No. 2,405,713, acid dyes such as 2',7'-dichlorofluoroscein dyes as described in West German Patent Applications (OLS) Nos. 2,404,591, 2,401,982, and 2,422,337 and in British Pat. No. 1,417,382 and merocyanine dyes as described in British Pat. Nos. 1,469,117 and 1,466,201 and Japanese Patent Application (OPI) No. 156424/75 are other examples of sensitizing dyes which can be similarly used in the present invention. Examples of effective merocyanine dyes which have pyrazolone nuclei are as follows:

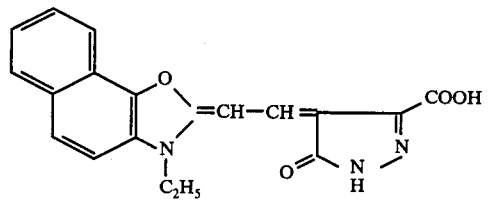

-continued

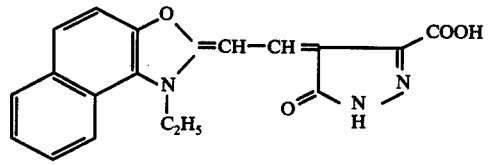

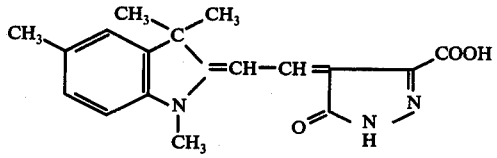

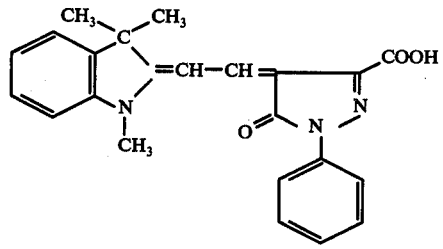

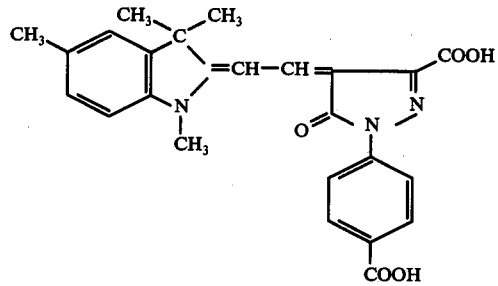

The amount of these dyes generally ranges from about 10-4 to about 1 mol per mol of the light-sensitive silver halide or the silver halide forming component.

The reducing agent of component (c) used in the heat developable light-sensitive materials of the present invention is a compound capable of reducing the organic silver salt component (a) when heated in the presence of an exposed silver halide and can be suitably selected depending upon the organic silver salt component (a) with which it is used in combination. Examples of such reducing agents include substituted phenols, substituted or unsubstituted bisphenols, substituted or unsubstituted mono- or bisnaphthols, di- or polyhydroxybenzenes, di- or polyhydroxynaphthalenes, hydroquinone monoethers, ascorbic acid and derivatives thereof, 3-pyrazolidones, pyrazolin-5-ones, reducing saccharides, aromatic primary amino compounds, reductones, kojic acid, hinokitiol, hydroxylamines, hydroxytetronic acids, hydroxytetronic acid amides, hydroxyamic acids, sulfhydrooxamic acids, hydrazides, indan-1,3-diones and p-oxyphenylglycines, etc. Of these reducing agents, reducing agents which are photolytically decomposed are preferred. Photolytically decomposable reducing agents are described in U.S. Pat. No. 3,827,889. Further, it is possible to use the reducing agents together with compounds which accelerate the photolysis, as described in U.S. Pat. No. 3,756,829. Blocked bisphenol type reducing agents are also used as preferred compounds and have been described in, for example, U.S. Pat. No. 3,589,903 and Japanese Patent Applications (OPI) Nos. 366110/75 and (OPI) 116023/75. Other examples of the reducing agents which can be used in the present invention are described in U.S. Pat. Nos. 3,152,904, 3,457,075, 3,531,286, 3,615,533, 3,679,426, 3,672,904, 3,751,252, 3,751,255, 3,782,949, 3,770,448 and 3,773,512, U.S Pat. No. 3,819,382 and Belgian Pat. No. 786,086.

Examples of suitable reducing agents are as follows:

(1) Substituted phenols: Aminophenols, for example, 2,4-diaminophenol, methylaminophenol, p-aminophenol, o-aminophenol, 2-methoxy-4-aminophenol and 2-$\beta$-hydroxyethyl-4-aminophenol, etc.; alkyl-substituted phenols, for example, p-t-butylphenol, p-t-amylphenol, p-cresol, 2,6-di-t-butyl-p-cresol, p-ethylphenol, p-sec-butylphenol, 2,3-dimethylphenol, 3,4-xylenol, 2,4-xylenol, 2,4-di-t-butylphenol, 2,4,5-trimethylphenol, p-nonylphenol and p-octylphenol, etc.; other phenols, for example, p-acetophenol, p-acetoacetyl-4-methylphenol, 1,4-dimethoxyphenol, 2,6-dimethoxyphenol, chlorothymol, 3,5-di-t-butyl-4-hydroxybenzyl-dimethylamine, and sulfonamidophenols, for example, compounds described in U.S. Pat. No. 3,801,321; and novolak resin type reaction products of formaldehyde and phenol derivatives (for example, 4-methoxyphenol, m-cresol, o- or p-butylphenol, 2,6-di-t-butylphenol and mixtures thereof, etc.);

(2) Substituted or unsubstituted bis, tris or tetrakis-phenols: o-bis-Phenols, for example, 1,1-bis-(2-hydroxy-3,5-dimethylphenyl)-3,5-trimethylhexane, bis-(2-hydroxy-3-t-butyl-5-methylphenyl)methane, bis-(2-hydroxy-3,5-di-t-butylphenyl)methane, bis-(2-hydroxy-3-t-butyl-5-ethylphenyl)methane, 2,6-methylene-bis-(2-hydroxy-3-t-butyl-5-methylphenyl)-4-methylphenol, 1,1-bis(5-chloro-2-hydroxyphenyl)methane, 2,2'-methylene-bis-4-methyl-6-(1-methylcyclohexyl)phenol, 1,1-bis-(2-hydroxy-3,5-dimethylphenyl)-2-methylpropane, 1,1,5,5-tetrakis-(2-hydroxy-3,5-dimethylphenyl)-2,4-ethylpentane and 3,3',5,5'-tetramethyl-6,6'-dihydroxytriphenylmethane; p-bis-phenols, for example, bisphenol A, 4,4'-methylene-bis-(3-methyl-5-t-butylphenol), 4,4'-methylene-bis-(2,6-di-t-heptylidene)di-(o-cresol), 4,4'-ethylidene-bis-(2,6-di-tert-butylphenol), 4,4'-(2-butylidene)-di-(2,6-xylenol), 4,4'-(p-methylbenzylidene)-di-(o-cresol), 4,4'-(p-methoxybenzylidene)-bis-(2,6-di-tert-butylphenol), 4,4'-(p-nitrobenzylidene)-di-(2,6-xylenol) and 4,4'-(p-hydroxybenzylidene)-di-(o-cresol); and others, for example, 3,5-di-t-butyl-4-hydroxybenzyldimethylamine, polyphenols such as $\alpha,\alpha'$-(3,5-di-t-butyl-4-hydroxyphenyl)dimethylether, 2,4,6-tris-(3,5-di-t-butyl-4-hydroxybenzyl)phenol, N,N'-di-(4-hydroxyphenyl)urea and tetrakis-[methylene-(3,5-di-t-butyl-4-hydroxyhydrocinnamate]methane, diethylstilbestrol, hexestrol, bis-(3,5-di-t-butyl-4-hydroxybenzyl)ether and 2,6-bis-(2'-hydroxy-3'-t-butyl-5'-hydroxybenzyl)-4-methylphenol, etc.

(3) Substituted or unsubstituted mono- or bis-naphthols and di- or polyhydroxynaphthalenes: bis-$\beta$-Naphthols, for example, 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis-(2-hydroxy-1-naphthyl)methane and 4,4'-dimethoxy-1,1'-dihydroxy-2,2'-binaphthyl; napthols, for example, $\alpha$-naphthol, $\beta$-naphthol, 1-hydroxy-4-aminonaphthalene, 1,5-dihydroxynaphthalene, 1,3-dihydroxynaphthalene, 1-hydroxy-2-phenyl-4-methoxynaphthalene, 1-hydroxy-2-methyl-4-methoxynaphthalene, 1-hydroxy-4-methoxynaphthalene, 1,4-dihydroxynaphthalene, methylhydroxynaphthalene, sodium 1-amino-2-naphthol-6-sulfonate, 1-naphthlamine-7-sulfonic acid and sulfonamidonaphthols as described in U.S. Pat. No. 3,801,321; etc.

(4) Di- or polyhydroxybenzenes and hydroxymonoethers (as described in, for example, U.S. Pat. No. 3,801,321): Hydroquinone; alkyl substituted hydroquinones, for example, methylhydroquinone, t-butylhydroquinone, 2,5-dimethylhydroquinone, 2,6-dimethylhydroquinone and t-octylhydroquinone, etc.; halogen-substituted hydroquinones, for example, chlorohydroquinone, dichlorohydroquinone and bromohydroquinone, etc.; alkoxy-substituted hydroquinone, for example, methoxyhydroquinone and ethoxyhydroquinone, etc.; other substituted hydroquinones, for example, phenylhydroquinone and hydroquinone monosulfonate, etc.; hydroquinone monoethers, for example, p-methoxyphenol, p-ethoxyphenol, hydroquinone monobenzyl ether, 2-t-butyl-4-methoxyphenol, 2,5-di-t-butyl-4-methoxyphenol, hydroquinone mono-n-propyl ether and hydroquinone mono-n-hexyl ether; and others, for example, catechol, pyrogallol, resorcinol, 1-chloro-2,4-dihydroxybenzene, 3,5-di-t-butyl-2,6-dihydroxybenzoic acid, 2,4-dihydroxybenzoic acid, 2,4-dihydroxyphenyl sulfide, methyl gallate, and propyl gallate, etc.

(5) Ascorbic acid and derivatives thereof: l-Ascorbic acid; isoascorbic acid; ascorbic acid monoesters, for example, ascorbic acid monolaurate, monomyristate, monopalmitate, monostearate and monobehenate; ascorbic acid diesters, for example, ascorbic acid dilaurate, dimyristate, dipalmitate and distearate; and the compounds described in U.S. Pat. No. 3,337,342.

(6) 3-Pyrazolines and pyrazolones: For example, 1-phenyl-3-pyrazolidone, 4-methyl-4-hydroxymethyl-1-phenyl-3-pyrazolidone, the compounds described in British Pat. No. 930,572, and 1-(2-quinolyl)-3-methyl-5-pyrazolone, etc.

(7) Reducing saccharides: For example, glucose and lactose, etc.

(8) Aromatic primary amino compounds: Examples of typical compounds include N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]aniline and 3-methyl-4-amino-N-ethyl-N-(β-hydroxyethyl)aniline, 4-amino-3-methyl-N-ethyl-N-(β-methanesulfoamidoethyl)aniline sesquisulfate monohydrate as described in U.S. Pat. No. 2,193,015, N-(2-amino-5-diethylaminophenylethyl)methanesulfoamide sulfate as described in U.S. Pat. No. 2,592,364, N,N-dimethyl-p-phenylenediamine hydrochloride and 3-methyl-4-amino-N-ethyl-N-methoxyethylaniline as described in Japanese Patent Application (OPI) 64,933/73, and the inorganic salts thereof.

(9) Hydroxylamines: For example, N,N-di-(2-ethoxyethyl)hydroxylamine, etc.

(10) Reductones: Anhydro-dihydroaminohexose reductones as described in, for example, U.S. Pat. No. 3,679,426, and linear aminoreductones as described in Belgian Pat. No. 786,086.

(11) Hydroxamic acids: For example, hydroxamic acids as described in U.S. Pat. Nos. 3,751,252 and 3,751,255.

(12) Hydrazides: For example, hydroxy substituted aliphatic acid aryl hydrazides as described in U.S. Pat. No. 3,782,949.

(13) Other compounds: For example, as described in British Pat. No. 1,338,427 and German Patent Laid-Open Application No. 2,031,748, pyrazoline-5-ones as described in U.S. Pat. No. 3,770,448, indan-1,3-diones having at least one hydrogen atom at the 2-position thereof as described in U.S. Pat. No. 3,773,512; amidoximes as described in U.S. Pat. No. 3,794,488, and reducing agents as described in U.S. Pat. No. 3,615,533 and U.S. Pat. No. 3,819,382, kojic acid, hinokitiol, hydroxytetronic acid, hydroxytetronamides, sulfhydrooxamic acids, p-oxyphenylglycine, etc.

Of these reducing agents, the compounds having an alkyl group (e.g., a methyl group, an ethyl group, a propyl group, an isopropyl group, a butyl group or an amyl group) on at least one position adjacent to the position at which a hydroxyl group is bonded to an aromatic nucleus are preferred because they are stable to light and color change due to exposure to light is small. For example, mono-, bis-, tris or tetrakis phenols having a 2,6-di-tert-butyl-phenol group are preferred examples of reducing agents. Typical examples of these compounds are (i) esters of carboxylic acids derived from phenols having a bulky substituent in at least one ortho-position with mono-hydric or poly-hydric alcohols or phenols, and (ii) esters of alcohols derived from phenols having a bulky substituent in at least one ortho-position or phenols having a bulky substituent in at least one ortho-portion with mono- or polycarboxylic acids. These esters can be represented by the formulae:

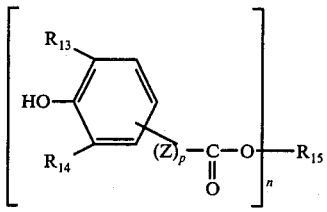

(IV)

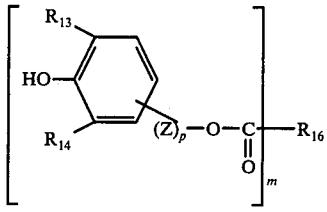

(V)

wherein Z is a di-valent group containing up to 30 carbon atoms, $R_{13}$ is an alkyl group having 1 to 20 carbon atoms, $R_{14}$ is a hydrogen atom or an alkyl group having 1 to 20 carbon atoms, $R_{15}$ is an alcohol residue, $R_{16}$ is a carboxylic acid residue, *n* and *m* each is a positive integer which is equal to number of alcohol and carboxylic acid residues, respectively, esterified, and *p* is 0 or 1. Specific examples of these compounds includes tetrakis[methylene-(3,5-di-tert-butyl-4-hydroxyhydrocinnamate)]methane and octadecyl-3-(3',5'-di-tert-butyl-4'-hydroxyphenyl)propionate.

It has been found that, of these esters, those represented by the following general formula (VI) provide an increased image density and desirable black tone when used in combination with phthalazinones, which can be present in the composition according to the invention as a particularly desirable activator toning agent as described hereinafter.

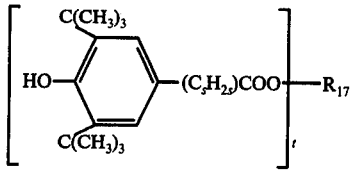

(VI)

wherein $R_{17}$ represents a residue of a saturated acyclic fatty alcohol represented by the formula $C_dH_{2d+2-t}$ wherein $d$ represents a positive integer of from 1 to 18 and $t$ represents a positive integer of from 1 to $2d+2$, and $s$ represents 1, 2, 3 or 4.

Further, photodecomposable reducing agents such as ascorbic acid and the derivatives thereof, furoin, benzoin, dihydroxyacetone, glyceraldehyde, rhodizonic acid tetrahydroxyquinone, 4-methoxy-1-naphthol, etc., are preferred. They are decomposed by light even if the light-sensitive materials in which they are present are allowed to stand in the light after development, whereby reduction does not proceed and so no color change occurs. Furthermore, direct positive images can be obtained by destroying the reducing agent upon image-wise exposure as disclosed in Japanese Patent Publications Nos. 22,185/70 and 41,865/71.

Other prefered reducing agents include, e.g., bisphenols having a 2,4-di-t-butylphenol group or 2,4-di-t-amylphenol group. Examples of the bisphenols are compounds shown by the following formula:

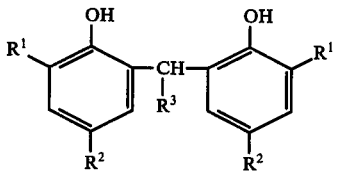

In the above formula, $R^1$ and $R^2$ represent a t-butyl group or a t-amyl group, and $R^3$ represents an alkyl group having 1 to 8 carbon atoms.

A suitable reducing agent used in selected based on the combination of the organic silver salt employed as the component (a) with which the reducing agent is used. For example, a strong reducing agent is suitable for a silver salt such as a silver salt of benzotriazole or silver behenate which is comparatively difficult to reduce, and a weak reducing agent is suitable for a silver salt such as silver caprate or silver laurate which is comparatively easy to reduce. That is, once the organic silver salt is determined, the reducing agent can be selected depending on the organic silver salt. Suitable reducing agents for silver benzotriazole are 1-phenyl-3-pyrazolidones, ascorbic acid, ascorbic acid monoesters and naphthols such as 4-methoxy-1-naphthols. Suitable reducing agents for silver behenate are o-bisphenols and hydroquinone. Suitable reducing agents for silver caprate and silver laurate are substituted tetrakisphenols, p-bisphenols such as substituted bisphenol A, and p-phenylphenol. The selection of an appropriate reducing agent for the organic silver salt can be facilitated by using two or more reducing agents.

The amount of the reducing agent used in the invention can widely vary depending on the kind of organic silver salt used, the kind of reducing agent used and the other additives present, but the amount of the reducing agent is generally about 0.05 to 10 mols, preferably about 0.1 to 3 mols, per mol of the organic silver salt.

The afore-said various reducing agents can be used as combinations of two or more thereof them. Specific examples of combinations of two or more reducing agents are described in Japanese Patent Application (OPI) No. 115540/74, and U.S. Pat. Nos. 3,667,958 and 3,751,249. Particularly effective combinations of reducing agents include an o- or p-bisphenols with at least one carboxylic ester derived from a phenol having a bulky substituent at the ortho position selected from the group consisting of the earlier described esters of a carboxylic acid derived from phenol having a bulky substituent at the ortho position with a mono- or polyhydric alcohol or a phenol, and the earlier described esters of mono- or polycarboxylic acid with a polyhydric phenol having a bulky substituent at the ortho position or an alcohol derived from a phenol having a bulky substituent at the ortho position. Using such combinations, a decrease in thermal fog, an increase in whiteness and an increase in light stabilization after processing are attained.

In addition, combinations of two mono- or polyphenolic reducing agents having alkyl groups, preferably with up to 4 carbon atoms, at both positions adjacent to the position of the aromatic nucleus at the hydroxyl substitution point are effective to prevent light discoloration. Moreover, it has been confirmed that development is accelerated using a reducing agent together with a compound of tin, iron, cobalt or nickel. The amount of auxiliary reducing agent can be varied widely depending upon the reducing abilities of the primary reducing agent and the auxiliary reducing agent, and the reducibility of the organic silver salt oxidizing agent, but a suitable amount generally ranges from about $10^{-5}$ to about 1 mol, preferably $10^{-3}$ to 0.8 mol, per mol of the primary reducing agent.

In forming a black image of silver using the heat developable light-sensitive material of the present invention, a color toning agent as an additive is preferably incorporated in the material. The color toning agent is used when it is desired to change the formed image into a deep color image and particularly into a black image. The amount of the color toning agent generally ranges from about 0.0001 mol to about 2 mols, and preferably about 0.0005 mol to about 1 mol, per mol of the organic silver salt. Although the color toning agent which is effective depends upon the organic silver salt and the reducing agent used, in general, heterocyclic organic compounds containing at least two hetero atoms wherein at least one nitrogen atom is present in the ring are used as a color toning agent. These compounds are described in, for example, U.S. Pat. No. 3,080,254. Phthalazone (phthalazinone), phthalic acid anhydride, 2-acetylphthalazinone, 2-phthaloylphthalazinone and substituted phthalazinone derivatives as described in West German Patent Application (OLS) No. 2,449,252 also can be suitably used in the present invention.

Examples of other effective color toning agents include pyrazolin-5-ones, cyclic imides and quinazolinone, as described in U.S. Pat. No. 3,846,136. For example, phthalimide, N-hydroxyphthalimide, N-potassium phthalimide and silver phthalimide are typical. Silver phthalazinone is also effective as a color toning agent. Other effective color toning agents are the mercapto compounds described in U.S. Pat. No. 3,832,186 and West German Patent Application (OLS) No. 2,321,217. In addition, the oxazinediones as described in West German Patent Application (OLS) No. 2,422,012, the phthalazine diones described in West German Patent Application (OLS) No. 2,449,252, the uracils described in British Pat. No. 1,462,016, the N-hydroxynaphthalimides described in U.S. Pat. No. 3,782,941, the substituted phthalimides described in West German Patent Application (OLS) Nos. 2,140,406, 2,141,063 and U.S. Pat. No. 3,844,797, and the phthalazinone derivatives described in West German Patent Application (OLS) No. 2,220,618 can be used too.

Preferably each component used in the present invention is included in a binder so as to provide a homogeneous film on a support. Although preferred binders are generally hydrophobic, hydrophilic binders can also be used. These binders are transparent or semi-transparent. For example, proteins such as gelatin or gelatin derivatives, cellulose derivatives, polysaccharides such as dextran, natural materials such as gum arabic, latex vinyl compounds which increase the dimensional stability of the photographic materials and synthetic polymers described hereinafter can be used. Preferred synthetic polymers are those described in U.S. Pat. Nos. 3,142,586, 3,193,386, 3,062,674, 3,220,844, 3,278,289 and 3,411,911. Effective polymers include water-insoluble polymers of alkyl acrylates and methacrylates, acrylic acid, sulfoalkyl acrylates or methacrylates, and compounds having a repeating sulfobetaine unit as described in Canadian Pat. No. 774,054. Examples of preferred high molecular weight materials and resins include polyvinyl butyral, polyacrylamide, cellulose acetate butyrate, cellulose acetate propionate, polymethyl methacrylate, polyvinyl pyrrolidone, polystyrene, ethyl cellulose, polyvinyl chloride, chlorinated rubber, polyisobutylene, butadiene-styrene copolymers vinyl chloride-vinyl acetate copolymers, vinyl acetate-vinyl chloride-maleic acid-terpolymers, polyvinyl alcohol, polyvinyl acetate, benzyl cellulose, polyvinyl acetate, acetylcellulose, cellulose propionate and cellulose acetate phthalate, etc. Of these polymers, polyvinyl butyral, polyvinyl acetate, ethyl cellulose, polymethyl methacrylate and cellulose acetate butyrate are more preferred. The most preferred material is polyvinyl butyral. If desired, two or more of these materials can be used as a mixture. The ratio by weight of the binder to the organic silver salt of component (a) generally ranges from about 10:1 to about 1:10 and preferably about 4:1 to about 1:4.

The layers containing each component described herein and other layers in the present invention can be applied to many kinds of supports. Examples of supports which can be used in the present invention are synthetic resin films such as cellulose nitrate films, cellulose ester films, polyvinyl acetal films, polyethylene films, polyethylene terephthalate films or polycarbonate films, etc., glass plates, paper and metal plates such as an aluminium plate, etc. Partially acetylated materials can also be used. Further, baryta paper, synthetic resin coated paper and water-resistant paper can be used as well. It is further preferred from the viewpoint of handling that the support be flexible. Art paper, coated paper and clay processed paper are preferred as paper supports, a polysaccharide, etc., is also preferred.

The various layers heretofore described are coated on a support, and in addition, the support itself can contain some components, if desired. For instance, a layer of the silver salt reducing agent, Pd-containing compound, toning agent, antifogging agent, etc. can be, used or, e.g., the Pd-containing compound toning agent and antifogging agent can be in the support.

When the desired components are incorporated in a support such as a plastic, glass or metal, difficulties, of course, arise which prevent the function(s) of the component(s) from being fully exhibited. However, with a support, e.g., made from paper as a base material, even when some components are incorporated in the support (the paper base material), they show quite the same effect as in the case of incorporating them in a layer or layers coated on the support. Whether the components are incorporated into the support or into the layer(s) coated on the support depends upon various conditions, e.g., the number of production steps desired necessary and advantageous conditions for production, etc. Either embodiment can easily be used, depending on the end-use contemplated.

If desired, a suitable pattern of ink or the like can be printed on the support either on the same side as is coated with a light-sensitive layer or layers or on the side which is not coated with a light-sensitive layer or layers. For example, such would be the case in using this invention for postcards, commuting tickets, and the like.

A suitable amount of silver coated on the support is generally within the range of about 0.05 to about 3 g, preferably 0.1 to 2 g per $m^2$ of support. Lesser amounts do not provide sufficient image density, while, on the other hand, greater amounts merely increase cost without substantially enhancing photographic characteristics.

The heat developable light-sensitive materials used in the present invention can have an antisatic layer or an electrically conductive layer. These layers can contain soluble salts such as halides or nitrates, ionic polymers as described in U.S. Pat. Nos. 2,861,056 and 3,206,312 and insoluble inorganic salts as described in U.S. Pat. No. 3,428,451. Further, the heat developable light-sensitive materials can have an evaporation-deposited metal layer. If desired, the heat developable light-sensitive materials of the present invention can contain an antihalation material or an antihalation dye. Preferred examples of such dyes are those dyes which are decolored upon heat development. For example, the dyes described in U.S. Pat. Nos. 3,768,019, 3,745,009 and 3,615,432 are preferred. Further, filter dyes or light absorbing materials as described in U.S. Pat. Nos. 3,253,921, 2,527,583 and 2,956,879 can be incorporated into the heat developable light-sensitive materials of this invention.

If desired, the heat developable light-sensitive materials of the present invention can contain a matting agent such as starch, titanium dioxide, zinc oxide, silica, polymer beads such as those described in U.S. Pat. Nos. 2,922,101 and 2,761,245, kaolin or clay, etc. Furthermore, they can contain an optical whitening agent such as the stilbenes, triazines, oxazoles or coumarins as described in, for example, German Pat. Nos. 972,067 and 1,150,274, French Pat. No. 1,530,244 and U.S. Pat. Nos. 2,933,390 and 3,406,070. These optical whitening agents can be used as an aqueous solution or as a dispersion.

The heat developable light-sensitive materials of the present invention can additionally contain a plastizer and a lubricant. For example, glycerin, diols, polyhydric alcohols as described in U.S. Pat. No. 2,960,404, aliphatic acids or esters as described in U.S. Pat. Nos. 2,588,765 and 3,121,060 and silicone resins described in, for example, British Pat. No. 955,061 can be used as plasticizers and lubricants. Furthermore, the light-sensitive materials can contain a surface active agent, for example, saponin and alkylaryl sulfonates described in, for example, U.S. Pat. No. 2,600,831, ampholytic compounds described in, for example, U.S. Pat. No. 3,133,816 and addition products of glycidol and alkyl phenols described in, for example, British Pat. No. 1,022,878. Hardenable layers of the heat developable light-sensitive layers used in the present invention can be hardened by organic or inorganic hardening agents. These hardening agents can be used individually or as a combination of two or more thereof. Preferred hardening agents are aldehydes, blocked aldehydes, ketones, carboxylic acids, carbonic acid derivatives, sulfonic acid esters, sulfonyl halides, vinyl sulfonyl esters, active halogen compounds, epoxy compounds, aziridines, active olefins, isocyanates, carbodiimides and polymeric hardening agents such as dialdehyde starch, etc. Further, many additives can be used for increasing the density of the resulting images. For example, non-aqueous polar organic solvents such as compounds having a $$-\underset{\underset{O}{\|}}{C}-, \quad -\underset{\underset{O}{\|}}{S}-$$

or $-SO_2-$ group as described in U.S. Pat. No. 3,667,959, for example, tetrahydrothiophene-1,1-dioxide, 4-hyroxybutanoic acid lactone and methylsulfinyl methane are effective. Zinc, cadmium and copper acetates as described in U.S. Pat. No. 3,708,304 are also effective. Furthermore, compounds containing water of crystallization as described in U.S. Pat. No. 3,635,719, acid salts of amines and compounds which become alkaline or heating such as metal oxides or hydroxides are effective as the materials for accelerating development. It is possible to use polyalkylene glycols together with mercaptotetrazole in order to improve the sensitivity, contrast and image density as described in U.S. Pat. No. 3,666,477.

The heat developable light-sensitive materials of the present invention can have a subbing layer between the support and the heat developable light-sensitive layer. Examples of binders which can be use for such a subbing layer include various polymers as described hereinbefore. For example, polyvinyl butyral, polyacrylamide, cellulose acetate butyrate, cellulose acetate propionate, polymethyl methacrylate, polystyrene, polyvinyl pyrrolidone, ethyl cellulose, polyvinyl chloride, chlorinated rubber, polyisobutylene, butadiene-styrene copolymers, vinyl chloride-vinyl acetate copolymers, vinyl acetate-vinyl chloride-maleic acid terpolymers, polyvinyl alcohol, polyvinyl acetate, cellulose acetate, cellulose propionate, cellulose acetate phthalate, gelatin, gelatin derivatives and polysaccharides, etc., can be used. It is possible to improve the photographic properties such as light-discoloration or heat fog, etc., by incorporating aliphatic acids or metal salts thereof in the subbing polymer layer. Further, it is possible to prevent permeation of solvents by incorporating pigments such as clay into the subbing layer. In addition, a matting agent such as silica, kaolin, titanium dioxide or zinc oxide can be added to the subbing layers. Further, a non-electrolytic deposition layer composed of a conductive metal as described in U.S. Pat. No. 3,748,137 can be present. It is also possible to improve the moisture resistance or to prevent curling in the case of a paper support by providing a hydrophobic polymer layer on the back of the support.

Further, it is possible to provide, if desired, a top-coating polymer layer on the light-sensitive layer in order to enhance the transparency of the heat developable light-sensitive layer, to increase the image density and to improve the shelf life, as described in West German Patent Application (OLS) No. 2,323,542. A preferred thickness for the top coating polymer layer ranges from about 1 micron to about 20 microns. Examples of polymers suitable for the top-coat polymer layer include polyvinyl chloride, polyvinyl acetate, vinyl acetate-vinyl chloride copolymers, polystyrene, polymethyl methacrylate, methyl cellulose, ethyl cellulose, cellulose acetate butyrate, cellulose acetate, polyvinylidene chloride, cellulose propionate, cellulose acetate phthalate, polycarbonate, cellulose acetate propionate and polyvinyl pyrrolidone, etc. A top coat polymer layer containing a material such as kaolin, silica or a polysaccharide such as starch therein, as described in Belgian Pat. No. 798,367 and Japanese Patent Application (OPI) No. 46,316/75 provides the heat developable light-sensitive material with the ability to be written upon with a ball-point pen or a pencil. Further, the top coat polymer layer can contain a filter dye, an ultraviolet light absorbing agent or an acid stabilizing agent such as higher aliphatic acids, etc.

Various methods can be utilized in order to prevent the generation of heat fog of the heat developable light-sensitive materials of the present invention. One method comprises using mercury compounds, as described in U.S. Pat. No. 3,589,903. Further, it is possible to form direct positive images using mercury compounds as described in U.S. Pat. No. 3,589,901. Furthermore, the mercury compounds can be used together with color forming couplers in order to form stabilized color images as described in U.S. Pat. No. 3,764,328. A second method for preventing the generation of heat fog is described in West German Pat. (OLS) Nos. 2,326,865, 2,402,161, 2,364,630, wherein N-halo compounds such as N-halosuccinimides or N-haloacetamides are used. Other methods for preventing the generation of heat fog are described in U.S. Pat. No. 3,645,739, West German Patent Application (OLS) No. 2,445,038, and Japanese Patent Applications (OPI) Nos. 89,720/73 and 125,016/74, wherein higher aliphatic acids such as lauric acid, myristic acid, palmitic acid, stearic acid or behenic acid, etc., tetrahalophthalic acid or the anhydrides thereof, aryl sulfonic acids such as benzene sulfonic acid or p-toluene sulfonic acid, aryl sulfinic acid or salts thereof such as benzene sulfinic acid or p-toluene sulfinic acid, and lithium salts of higher aliphatic acids such as lithium stearate, etc., are used as acid stabilizing agents. Other effective acid stabilizing agents include salicyclic acid, p-hydroxybenzoic acid, tetrabromobenzoic acid, tetrachlorobenzoic acid, p-acetamidobenzoic acid, alkyl substituted benzoic acids such as p-t-butylbenzoic acid, phthalic acid, isophthalic acid, trimellitic acid, pyromellitic acid, diphenic acid, and 5,5'-methylene-bis-salicyclic acid. These acid stabilizing agents not only prevent the generation of heat fog but also sometimes have the functions of preventing discoloration when exposed to white light, increasing the image density or improving the shelf life (the property that the photographic properties of the light-sensitive material possessed just after production was maintained after storage). Other compounds which are effective for preventing generation of heat fog are benzotriazole and derivatives thereof, thiouracils, for example, 2-thiouracils represented by the formula (VII):

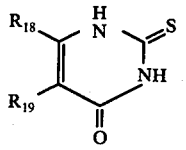

(VII)

wherein $R_{18}$ represents a hydrogen atom; a hydroxyl group, an alkoxy group, a halogen atom, an unsubstituted or substituted lower alkyl group, a benzyl group, an allyl group, an amino group, a nitro group or a nitroso group, and $R_{19}$ represents a hydrogen atom, a hydroxyl group, a halogen atom, an amino group, an acetamido group, an unsubstituted or substituted alkyl group having 1 to 22 carbon atoms, an aryl group, such as a phenyl group, or a substituted aryl group, 1-phenyl-5-mercaptotetrazole, azole-thioethers, blocked azolethiones, peroxides as described in British Pat. No. 1,460,868, persulfates, disulfides, e.g.,

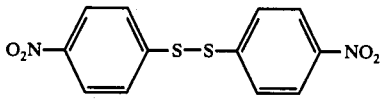

etc. Furthermore, it is effective to prevent thermal fog or to improve photographic properties such as sensitization, to add a chromium salt, rhodium salt, copper salt, nickel salt, cobalt salt; or complex salts such as those of rhodium, iron or cobalt during or prior to silver halide formation.

In order to prevent discoloration by light of the processed light-sensitive material (the phenomenon in which an unexposed area of the light-sensitive material after processing is discolored gradually by light when exposed to normal room illumination), it is possible to use stabilizer precursors such as azole thioethers or blocked azolethiones as described in U.S. Pat. No. 3,839,049, tetrazolyl thio compounds as described in U.S. Pat. No. 3,700,457 and light-sensitive halogen-containing organic oxidizing agents as described in U.S. Pat. No. 3,707,377.

In addition, it is possible to use light adsorbing dyes as described in British Pat. No. 1,261,102, for, particularly, transmission light-sensitive materials in order to improve the resolving power. Further, it is possible to use leuco dye compounds described in, for example, West German Patent Application (OLS) No. 2,446,892 in order to improve the shelf life. It is also possible to increase the whiteness by blueing the elements using blue dyes such as Victoria Blue so that the color stain of dyes can be reduced, as described in Japanese Patent Application (OPI) No. 116023/75.

Further, it is possible in some cases to stabilize the processed light-sensitive materials to light or heat. Effective methods include the process described in U.S. Pat. No. 3,617,289 which comprises stabilizing the materials using a solution containing mercapto compounds and the method described in West German Patent Application (OLS) No. 2,445,292 which comprises providing a laminate containing a stabilizing agent.

The heat developable light-sensitive materials of the present invention are cut to appropriate sizes and are developed by heating after image exposure.

The light-sensitive materials of the invention can be preheated before exposure to light as described above (to about 80° to 140° C). Light sources suitable for image exposure are tungsten lamps, fluorescent lamps used for exposing diazotype light-sensitive materials, mercury lamps, xenon lamps, cathode ray tube (CRT) light sources and laser light sources, etc. As originals, not only line images such as drawings but also photographic images having gradation can be used. Further, it is possible to directly photograph people and landscapes using a camera. The light-sensitive materials can be printed by direct contact of the light-sensitive material with the original, or can be printed using a reflection printing method or using an enlarging printing method. Although exposure depends upon the sensitivity of the light-sensitive materials, an exposure of about 10 lux. seconds is required for high speed sensitive materials and an exposure of about $10^4$ lux . seconds is required for low speed sensitive materials. The thus image-exposed light-sensitive materials can be developed simply by heating (e.g., to about 80° to about 180° C, preferably about 100° to about 150° C). The heating time can be suitably, for example, about 1 to 60 seconds. The heating time, of course, is related to the heating temperature employed. In general, a suitable heating time is about 5 to about 40 seconds at 120° C, about 2 to about 20 seconds at 130° C and about 1 to about 10 seconds at 140° C.

Various means can be used for heating. For example, the light-sensitive material can be contacted with a simple heated plate or with a heated drum or, if desired, it can be passed through a heated space. Further, the heating can be carried out by high frequency heating or by laser beams. In order to prevent a bad odor from being emitted on heating, the processing devices can be equipped with a deodorizer. It is also possible to incorporate certain perfumes so as to mask any bad odor of the light-sensitive materials which might be formed.

The preparation of heat developable light-sensitive materials of the invention will be illustrated by reference to the following examples and is briefly explained as follows.

An organic silver salt-forming agent is reacted with a silver iron-providing agent (e.g., silver nitrate) using one of the various methods described above to form an organic silver salt. The preparation conditions are at atmospheric pressure and a temperature of about −15° to 80° C, preferably about 20° to 60° C. After washing the prepared organic silver salt with water or an alcohol, the salt is dispersed in a binder for an emulsion using a colloid mill, a mixer or a ball mill at normal temperature (e.g., about 15° to 25° C). To the polymer dispersion of the silver salt, a silver halide forming agent is added to convert a part of the organic silver salt to silver halide. In this case, the reaction temperature ranges from about normal temperature to about 80° C, and the reaction time is about 1 minute up to about 48 hours. Further, a previously prepared silver halide as described above can be added, or silver halide can be simultaneously prepared along with the organic silver salt. Then, any additives such as spectral sensitizing dyes, reducing agents or toning agents are added, preferably as solutions thereof. These solutions are usually added at suitable intervals (e.g., about 5 to 20 minutes) to the system with stirring at about normal temperature to 50° C. When all additives have been added, the coating composition is then coated on a suitable support using conventional coating apparatus. The temperature of the coating ranges from about 5° to 50° C. The coating composition as such is coated on a suitable support and thereafter dried e.g., at 30° to 100° C. In the same manner as above for forming the thermally developable light-sensitive layer, a topcoat polymer layer, a subbing layer, a backing layer and other layers can be formed by preparing respective coating compositions and successively coating them by various coating methods such as a dipping method, air-knife coating method, curtain coating method or hopper coating method. If desired, two or more layers can be simultaneously coated by the method as described in U.S. Pat. No. 2,761,791 and British Pat. No. 837,095.

Thermally developable light-sensitive materials of this invention generally have the property that their photographic characteristics are liable to be deteriorated by moisture. Therefore, when the prepared light-sensitive materials are packed and shipped as commercial goods, it is preferred to add a desiccating agent thereto, as described in Japanese Patent Application (OPI) No. 2523/75.

It has been found that the thermally developable light-sensitive materials of this invention provide remarkably low thermal fog, particularly thermal fog caused upon storage at high temperatures for a long periods of time.

Moreover, the thermally developable light-sensitive materials of this invention are easy to handle as they certain no toxic substances such as mercury, and high image density is obtained therefrom.

The thermally developable light-sensitive materials of this invention have the above advantages and, therefore, are commercially quite desirable.

The following examples are given to illustrate this invention in specific detail without limiting the same. All processings were at atmospheric pressure and at room temperature, all parts, percents and ratios were by weight, and all thicknesses were dry thicknesses, unless otherwise indicated, in the following

EXAMPLE 1

1.9 g of sodium hydroxide was dissolved in 100 ml of water, which was mixed with a solution of 12 g of lauric acid dissolved in 100 ml of toluene to make an emulsion (at 25° C).

Next, an aqueous solution of 8.5 g of silver nitrate dissolved in 50 ml of water was added. When the mixed solution was allowed to stand for 5 minutes, it separated into a toluene phase containing silver laurate and an aqueous phase. After the aqueous phase was removed, the toluene phase was dispersed in 200 ml of ethanol, and silver laurate was collected by centrifuging. There was thus obtained 12 g of spindle-shaped silver laurate crystals with a diameter of about 3 microns. It should be noted that even with intimate contact with a silver halide, crystals having a size of more than 10 $\mu$ are not easily developed.

When benzene, pentane, cyclohexane, butyl acetate, isoamyl acetate, butyl alcohol, tricresyl phosphate or dibutyl phthalate was used in place of toluene, silver laurate was produced of substantially the same quality and shape.

6 g of the resulting silver laurate (about 1/50 mol) and 12 g of polyvinyl butyral (or 12 g of ethyl cellulose) were dispersed in 70 g of ethyl alcohol using a mixer to produce a polymer dispersion of the silver salt. The same result was obtained when methanol, propanol or isopropanol was used in place of the ethyl alcohol. Keeping the polymer dispersion of the silver salt at 50° C and stirring using a stirrer, 0.15 g of N-bromosuccinimide (silver halide forming component) was added thereto. Heating was then, effected for 90 minutes.

Other N-halogeno compounds such as N-bromoacetamide or N-bromophthalazinone can also be used in place of N-bromosuccinimide.

Thereafter, the temperature of the system was reduced to 30° C and maintainted at that temperature. While stirring, the following components were successively added at 5 minute intervals to form a coating composition.

(a) Pd $(acac)_2$
(0.1 wt% acetone solution) 5 ml (b) sensitizing dye (a merocyanine dye of the following formula)

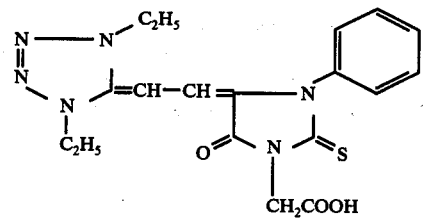

(0.025 wt% methyl cellusolve solution) 10 ml
(In place of the above dye, other merocyanine dyes, other cyanine dyes, acid dyes, and the like cam also be used.)

(c) sodium benzenesulfinate dihydrate (stabilizer)
(0.1 wt% methanol solution) 5 ml (d) lauric acid (stabilizer)
(3 wt% ethanol solution) 30 ml (e) phthalazone (color toning agent)
(3 wt% methanol solution) 40 ml (f) reducing agent
2,2-bis(3,5-di-methyl-4-hydroxyphenyl)-propane
(20 wt% acetone solution) 25 ml The coating composition thus prepared was coating on art paper as a support (other papers such as loaded papers, a photographic base paper, and a base paper for pressure-sensitive papers) and on a polyethylene terephthalate (PET) film as a support at a silver coverage of 0.3 g per $m^2$ in the case of the paper and at a silver coverage of 1.5 g per $m^2$ in the case of the PET film. In the case of the paper support, a dispersion prepared by dispersing silica into a 10 wt% ethanol solution of ethyl cellulose was coated on the light-sensitive layer to provide an overcoat polymer layer (containing one part of silica per 10 parts of ethyl cellulose) of a film thickness of about 1.5 microns, and in the case of the film support, a 15 wt% tetrahydrofuran solution of a copolymer of vinyl chloride and vinyl acetate (weight ratio of 85:15) was overcoated on the light-sensitive layer to provide an overcoat polymer layer of a film thickness of about 3 microns.

The thermally developable light-sensitive materials thus prepared were denoted materials (1) (1)' (the symbol with the dash indicates the coated PET film; the same shall be hereinafter used).

For comparison, thermally developable light-sensitive materials (2) and (2)' were prepared in the same manner excepting that $Pd(acac)_2$, the characteristic component of this invention, was omitted.

The thermally developable light-sensitive materials thus prepared were image-wise exposed through an original with gradation to a tungsten light source, the amount of exposure being $10^4$ lux.sec, and then developed by heating at 135° C for 3 seconds.

There was no difference in the fresh photographic properties of the images formed among (1), (1)', (2) and (2)' (such a processing is referred to as "fresh" hereinafter).

Thermally developable light-sensitive materials identical to those above were than kept at 50° C and 50% in the dark for 1 day and then image-wise exposed and developed in the same manner as in "fresh" processing to obtain a step-wise image (such processing is referred to as "forced ageing" hereinafter). (1) and (1)' showed less thermal fog as compared with (2) and (2)'. The characteristic curves of (1) and (2) are shown in the accompanying drawing.

D-log E characteristic curves can be obtained in which the relative exposure amount (log E) is expressed along the abscissa and the photographic density (as measured, blackening reflection density was given in units of optical density) is expressed along the ordinate.

| | Fog Density * |
|---|---|
| Fresh (1) | 0.05 |
| Fresh (2) | 0.05 |
| Forced Ageing (1) | 0.06 |
| Forced Ageing (2) | 0.38 |

* measured in a conventional manner using a reflection densitometer produced by Macbeth Co.

When the same procedures as above were repeated using a silver salt of myristic acid, palmitic acid, stearic acid or behenic acid in place of silver laurate, the results showed the same trends, i.e., the palladium-containing compound of this invention prevents the occurrence of thermal fog with the passage of time.

EXAMPLE 2 (Comparative Example)

The same method as in Example 1 was repeated, but component (a) as used in Example 1 was added in an amount 1/10 of that used in Example 1, and then heating was effected at 50° C for 90 minutes. Thereafter, the temperature was reduced to 30° C and maintained at that point. While stirring, components (b), (c), (d), (e) and (f) as were used in Example 1 were added at 5-minute intervals to prepare a coating composition which was coated as in Example 1.

When the thermally developable light-sensitive material thus prepared was subjected to forced ageing processing, the thermal fog density was 0.05, showing no difference from thermally developable light-sensitive material (1) of Example 1.

For comparison, a thermally developable light-sensitive material was prepared in the same manner as in Example 1 except for adding component (a) in an amount 1/10 of that used in Example 1, and then subjected to forced ageing processing. The thermal fog density was 0.20.

As described above, the amount of the palladium-containing compound can be reduced by varying the addition method.

EXAMPLE 3 (Comparative Example)

The procedure of Example 1 was repeated except for using an aqueous solution of $K_2PdCl_4$ or $K_2PdBr_4$ as described in U.S. Pat. No. 2,566,263 in an amount equimolar to component (a) of Example 1 instead of component (a) in Example 1.

When the thermally developable light-sensitive material thus prepared were subjected to fresh processing, thermal fog was high.

In the case of adding $1 \times 10^{-6}$ mol of $K_2PdCl_4$ or $K_2PdBr_4$ mol of silver salt, thermal fog was not increased by fresh processing, but thermally developable light-sensitive materials subjected to forced ageing processing showed increased thermal fog and illustrated a thermal fog density of 0.40. That is, when the amount of the palladium-containing compound is reduced to the minimal amount to prevent an increase in thermal fog in fresh processing, the effect of preventing thermal fog with the passage of time is lost. Therefore, $K_2PdCl_4$ and $K_2PdBr_4$ are excluded from the palladium-containing compounds of this invention.

EXAMPLE 4

An aqueous solution of 0.8 g of cetylethyldimethylammonium bromide dissolved in 100 ml of water was mixed with 100 ml of toluene to form an emulsion. A solution of 0.425 g of silver nitrate dissolved in 10 ml of water was added thereto to produce silver bromide. The silver bromide was present in the emulsified state. There was then added thereto an emulsion prepared by mixing a solution of 12 g of lauric acid dissolved in 100 ml of toluene with a solution of 1.9 g of sodium hydroxide dissolved in 100 ml of water.

Next, a solution of 8.5 g of silver nitrate dissolved in 50 ml of water was added to produce silver laurate. Thus, a mixture in which silver nitrate and silver laurate were in intimate contact with each other was obtained.

In the above manner, other oils which are relatively immiscible with water can be used in place of toluene, and silver bromide can be replaced with silver bromiodide, silver chlorobromide or silver chlorobromoiodide. Other silver halide forming components can be used in place of cetylethyldimethylammonium bromide. In place of silver laurate, other silver salts of aliphatic acids such as silver myristate or silver palmitate can be used, and further, other organic silver salts can easily be used, which will be obvious to those skilled in the art.

The mixture thus formed was collected by centrifuging, and dispersed in 200 g of a solution containing 30 g of polyvinyl butyral (as a binder) in ethanol (other alcohols such as methanol, n-propyl alcohol or isopropyl alcohol can be used) by means of a mixer to prepare a polymer dispersion of the silver salts.

The polymer dispersion of the silver salts was kept at 30° C, and the following components successively added thereto at 5-minute intervals to yield a coating composition.

(a) $Pd(acac)_2$
(0.1 wt% acetone solution) 10 ml
(b) sodium benzenesulfinate dihydrate
(0.1 wt% methanol solution) 20 ml
(c) lauric acid
(3 wt% ethanol solution) 70 ml
(d) dye

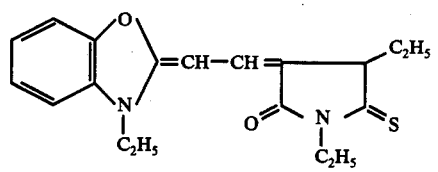

(0.025% methanol solution) 10 ml
(Other merocyanine dyes, cyanine dyes, rhodacyanine dyes, styryl series dyes, acid dyes, and the like can also be used.)

(e) phthalazone (color toning agent)
(3 wt% methanol solution) 120 ml (f) reducing agent
tetrakis-[methylene-(3,5-di-tertiary-butyl-4-hydroxyhydrocinnamate)]-methane
(20 wt% acetone solution) 100 ml (g) Victoria blue B (bluing agent)
(0.05 wt% methanol solution) 2 ml
(Other blue dyes can also be used)

When high sensitivity is not especially required, the sensitizing dye can be omitted from the above components. Moreover, when an image of a yellowish brown tone is permissible, phthalazone (= phthalazinone) can be omitted.

The coating composition thus prepared was coated on a base paper for a carbonless paper as a support at a silver coverage of 0.5 g per $m^2$.

An acetone solution of 10 wt% cellulose diacetate containing 1.5 wt% of kaolin was coated on the light-sensitive layer so as to provide a film thickness of 1.5 microns, thus forming an overcoat polymer layer.

When silica was used in the same amount in place of kaolin or art paper was used as the support, equivalent results were obtained.

The thermally developable light-sensitive material thus prepared was referred to as (1). For comparison, a thermally developable light-sensitive material (2) was prepared which was the same as (1) except that component (a) of this invention, the palladium-containing compound, was omitted.

On comparing the thermal fog densities of thermally developable light-sensitive materials (1) and (2) after fresh processing and forced ageing processing as in Example 1, there was little difference for fresh processing, but for forced ageing processing, the thermally developable light-sensitive material (1) provided less thermal fog than that of (2).

While the invention has been described in detail and with reference to specific embodiments thereof, it will be apparent to one skilled in the art that various changes and modifications can be made therein without departing from the spirit and scope thereof.

What is claimed is:

1. In a thermally developable light-sensitive material comprising a support having thereon at least one layer containing at least (1) an organic silver salt, (b) a light-sensitive silver halide or a component capable of forming a light-sensitive silver halide and (c) a reducing agent, the improvement which comprises the material further comprising (d)(i) a palladium-containing compound in at least one layer provided on the support or (d)(ii) a palladium-containing compound in the support, wherein said palladium-containing compound is present in an amount of about $10^{-8}$ to about $10^{-2}$ mole per mole of the organic silver salt, and, said palladium-containing compound has the general formula:

$$Pd\ (R_1COCHCOR_2)_2$$

wherein $R_1$ and $R_2$ have the following meaning:

| $R_1$ | $R_2$ |
|---|---|
| $C_6H_5$ | $C_6H_5$ |
| $C_6H_5$ | $CH_3$ |
| $CH_3$ | $CH_3$ |
| $CF_3$ | $CH_3$ |

or has the general formula:

$$L_2PdX_2$$

wherein L and X have the following meaning:

| L | X |
|---|---|
| $C_6H_5CH_2SCH_2C_6H_5$ | Cl |
| 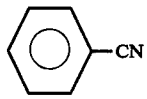 | Cl |
| $CH_2{=}CHCN$ | Cl |
| 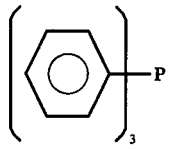 | Cl |
| $(C_2H_5)_3P$ | Br |
| 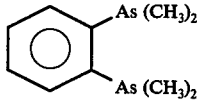 | I |
| 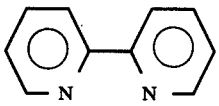 | Cl |

or has the general formula:

$$Pd\ (DMGH)_2$$

wherein DMGH:

$$\begin{array}{l} CH_3{-}C{=}NOH. \\ \quad\ \ | \\ CH_3{-}C{=}NOH \end{array}$$

2. The material of claim 1 wherein said palladium-containing compound has the general formulae:

$$Pd\ (R_1COCHCOR_2)_2$$

wherein $R_1$ and $R_2$ have the following meaning:

| $R_1$ | $R_2$ |
|---|---|
| $C_6H_5$ | $C_6H_5$ |
| $C_6H_5$ | $CH_3$ |
| $CH_3$ | $CH_3$ |

-continued

| $R_1$ | $R_2$ |
|---|---|
| $CF_3$ | $CH_3$ |

3. The material of claim 1 wherein said palladium-containing compound has the general formulae:

$L_2PdX_2$ wherein L and X have the following meaning:

| L | X |
|---|---|
| $C_6H_5CH_2SCH_2C_6H_5$ | Cl |
| 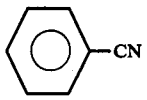 | Cl |
| $CH_2{=}CHCN$ | Cl |
| 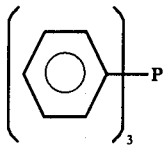 | Cl |
| $(C_2H_5)_3P$ | Br |
| 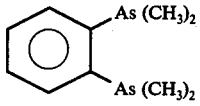 | I |
| 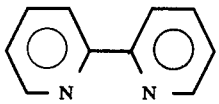 | Cl |

4. The material of claim 1 wherein said palladium-containing compound has the general formulae:

$Pd\ (DMGH)_2$ wherein DMGH:

$$\begin{array}{l} CH_3{-}C{=}NOH. \\ \quad\quad\ \ | \\ CH_3{-}C{=}NOH \end{array}$$

5. the material of claim 1 wherein said palladium-containing compound is a palladium complex salt of acetylacetone.

6. The material of claim 1, wherein components (a), (b), (c) and (d) are all present in one or more layers on the support.

7. The material of claim 1, wherein components (a), (b) and (c) are present in one or more layers on the support and component (d) is present in said support.

8. The material of claim 7, wherein the support is paper.

9. The material of claim 1, wherein said organic silver salt is a silver salt of an organic compound which is comparatively stable to light upon exposure but which reacts with the reducing agents to form a silver image when heated to a temperature of about 80° C or higher.

10. The material of claim 9, wherein component (b) is the component capable of forming a light-sensitive silver halide.

11. The material of claim 9, wherein the silver halide forming component or silver halide per se is present in an amount of from 0.001 to 0.5 mole per mole of the organic silver salt, and the reducing agent is used in an amount of from about 0.05 to 10 moles per mole of the organic silver salt.

12. The material of claim 11, wherein the amount of silver coated on the support is within the range of about 0.05 to 3 g per $m^2$ of the support.

* * * * *